US007131660B2

(12) United States Patent
Hafer

(10) Patent No.: US 7,131,660 B2
(45) Date of Patent: Nov. 7, 2006

(54) ICE CARVER SKI

(76) Inventor: Thomas Frederick Hafer, 3805 N. Harrison St., Arlington, VA (US) 22207

( * ) Notice: Subject to any disclaimer, the term of this patent is extended or adjusted under 35 U.S.C. 154(b) by 139 days.

(21) Appl. No.: 10/685,646

(22) Filed: Oct. 15, 2003

(65) Prior Publication Data

US 2004/0080142 A1 Apr. 29, 2004

Related U.S. Application Data

(60) Provisional application No. 60/418,589, filed on Oct. 15, 2002.

(51) Int. Cl.
*A63C 5/00* (2006.01)

(52) U.S. Cl. ..... 280/608; 280/609; 280/809

(58) Field of Classification Search ..... 280/601, 280/608, 609, 809, 816, 28.15, 28.16
See application file for complete search history.

(56) References Cited

U.S. PATENT DOCUMENTS 4,083,577 A * 4/1978 Ford ..... 280/609
4,219,214 A * 8/1980 Kostov ..... 280/605
4,652,006 A * 3/1987 Desoutter ..... 280/604
4,906,016 A * 3/1990 Varan et al. ..... 280/608
5,303,949 A * 4/1994 Harper et al. ..... 280/608
5,462,304 A * 10/1995 Nyman ..... 280/609
6,007,101 A * 12/1999 Pritchard et al. ..... 280/809
6,062,585 A * 5/2000 Hess ..... 280/608
6,264,215 B1 * 7/2001 Carlson et al. ..... 280/14.21
6,367,173 B1 * 4/2002 Lancon ..... 36/122
6,702,315 B1 * 3/2004 Barbieri et al. ..... 280/605
6,857,653 B1 * 2/2005 Wilson ..... 280/602
6,866,273 B1 * 3/2005 Barbieri et al. ..... 280/14.21

* cited by examiner

*Primary Examiner*—Christopher P. Ellis
*Assistant Examiner*—Brian Swenson
(74) *Attorney, Agent, or Firm*—James Marc Leas

(57) ABSTRACT

An outrigger edge enhances ability to turn and maintain control of a ski or snowboard on ice or snow. The outrigger edge is provided outside and above the normal edge of a ski so it only makes contact with the snow or ice when the ski is tilted through a sufficient angle with respect to the surface of the snow or ice. The angle is preferably in the range from about 30 to about 60 degrees, more preferably around 45 degrees, to reduce or avoid contact during skiing on flat terrain but to allow contact when needed on ice.

29 Claims, 12 Drawing Sheets

ICE CARVER SKI

RELATED APPLICATIONS

This patent application claims priority of Provisional Patent Application 60/418,589 filed on Oct. 15, 2002, incorporated herein by reference.

FIELD OF THE INVENTION

This invention generally relates to skiing in icy conditions. More particularly, it relates to an improved edge for a ski. Even more particularly, it relates to an edge that provides greater control in icy conditions.

BACKGROUND OF THE INVENTION

Icy conditions can make skiing difficult and hazardous. In good snow conditions, turning and stopping are accomplished by tilting the skis, causing their edges to cut into the snow. However, the ski edges cannot easily cut into ice. A common occurrence when attempting to turn on ice is that one or both ski edges fail to penetrate into the icy surface, the skis lose their hold, and the skier slips sideways downhill, resulting in a loss of control, and often a fall.

The present inventor found that no system is presently available that provides a skier with sufficient ability to maintain control in icy conditions. Thus, a better system for providing an edge cutting into or holding onto ice is needed, and this solution is provided by the following invention.

SUMMARY OF THE INVENTION

It is therefore an object of the present invention to provide a device that improves control of skis in icy conditions;

It is a further object of the present invention to provide a device that increases the amount of edge on a ski;

It is a further object of the present invention to provide outrigger edges to increase the amount of edge touching the snow or ice surface when turning, stopping, or traversing, so as to improve control in icy conditions;

It is a feature of the present invention that outrigger edges are provided at edges of a bent metal plate that is removably connected to a top surface of the ski;

It is a feature of the present invention that outrigger edges are provided at edges of a bent metal plate that is integrated with a ski;

It is an advantage of the present invention that improved control is provided when skiing in icy conditions.

These and other objects, features, and advantages of the invention are accomplished with a device for skiing that includes a ski having a first side and a bottom surface. The bottom surface has a first edge on the first side. The ski further includes a first outrigger edge on the first side, wherein the first outrigger edge extends from the ski spaced from the first edge.

Another aspect of the invention is a method of skiing on snow or ice, comprising the step of providing a ski having an outrigger edge. The method also includes the step of skiing on this ski. Finally the method includes the step of tilting this ski to engage the outrigger edge with the snow or ice.

Another aspect of the invention is a method of fabricating a ski for skiing on hard snow or ice. The method includes the step of providing a ski. The method also includes the step of providing a plate having outrigger edges. Finally the method includes the step of mounting this plate to this ski.

BRIEF DESCRIPTION OF THE DRAWINGS

The foregoing and other objects, features, and advantages of the invention will be apparent from the following detailed description of the invention, as illustrated in the accompanying drawings, in which.

DETAILED DESCRIPTION OF THE INVENTION

Although the present invention can improve skiing with most types of skis and ski equipment, it is of particular advantage with modem shaped skis that have curved edges, such as parabolic edges. These skis are wider in front and rear portions of the ski compared to the middle portion. When turning or stopping shaped skis spread the pressure more evenly over the edge of the ski, resulting in sharper turns when snow conditions are good, but also reducing the ability of the ski to concentrate pressure in order to bite into ice.

Application of the present invention near the skier's center of gravity on a shaped ski improves ability to bite into ice and retain control while retaining the shaped skis advantages. The inventor has tested and used the present invention in this manner with superior results.

The present invention is also of particular advantage when used on skis with modern step-in bindings because these bindings leave the area under the skier's foot open, avoiding interference between the invention and the bindings. Thus, with step in bindings, the invention is more easily connected and disconnected from the ski and does not interfere with the binding.

The present invention can also be applied to snowboards in a manner similar to that described herein below for skis in order to improve the ability of snowboards to retain control on ice. In this application the term "ski" applies to all kinds of skis and snowboards.

Figure 1A:
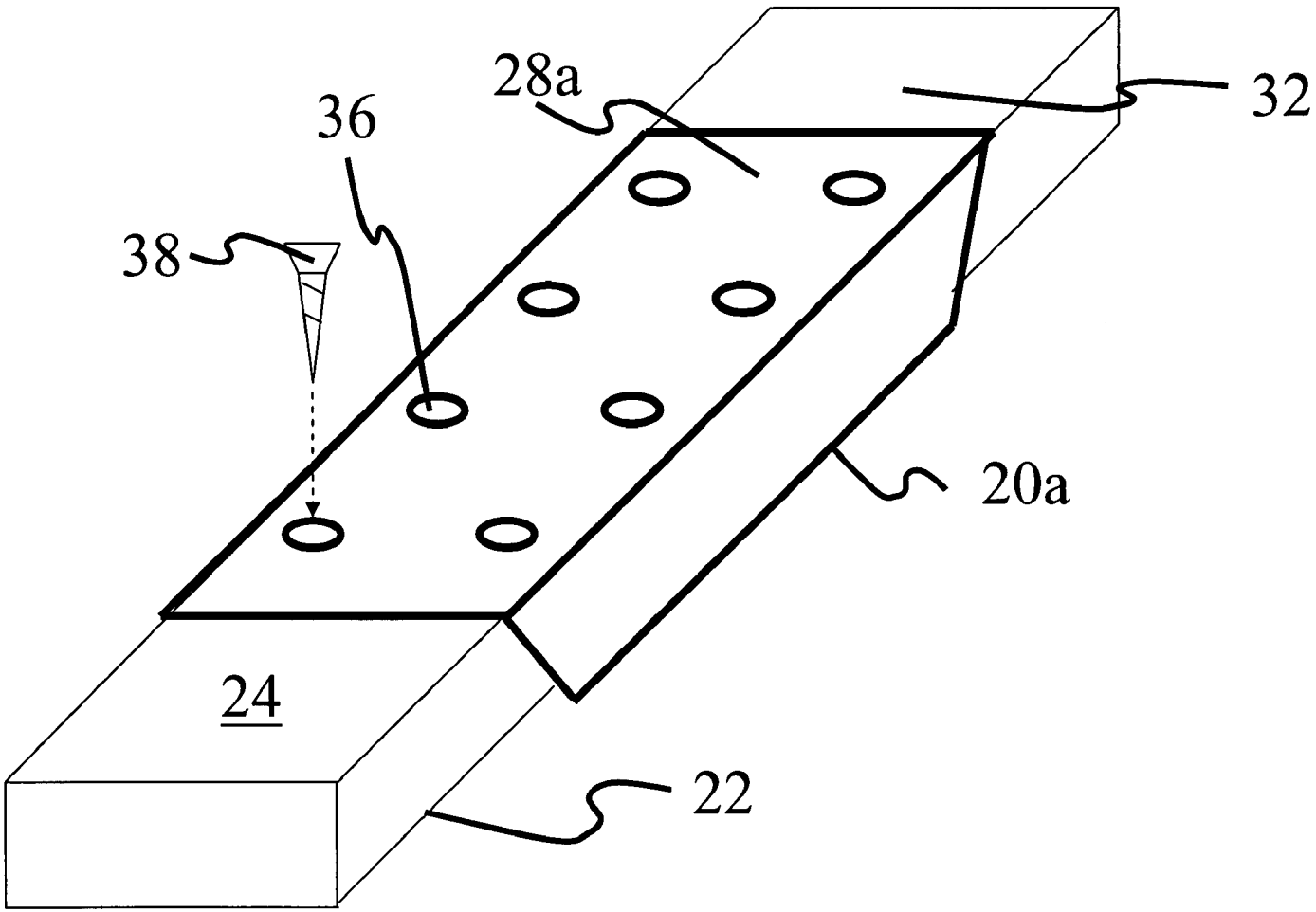
FIG. 1*a* is a three dimensional view of a ski having a removable metal plate connected to its top surface in which the plate includes the outrigger edges of the present invention.
Figure 1B:
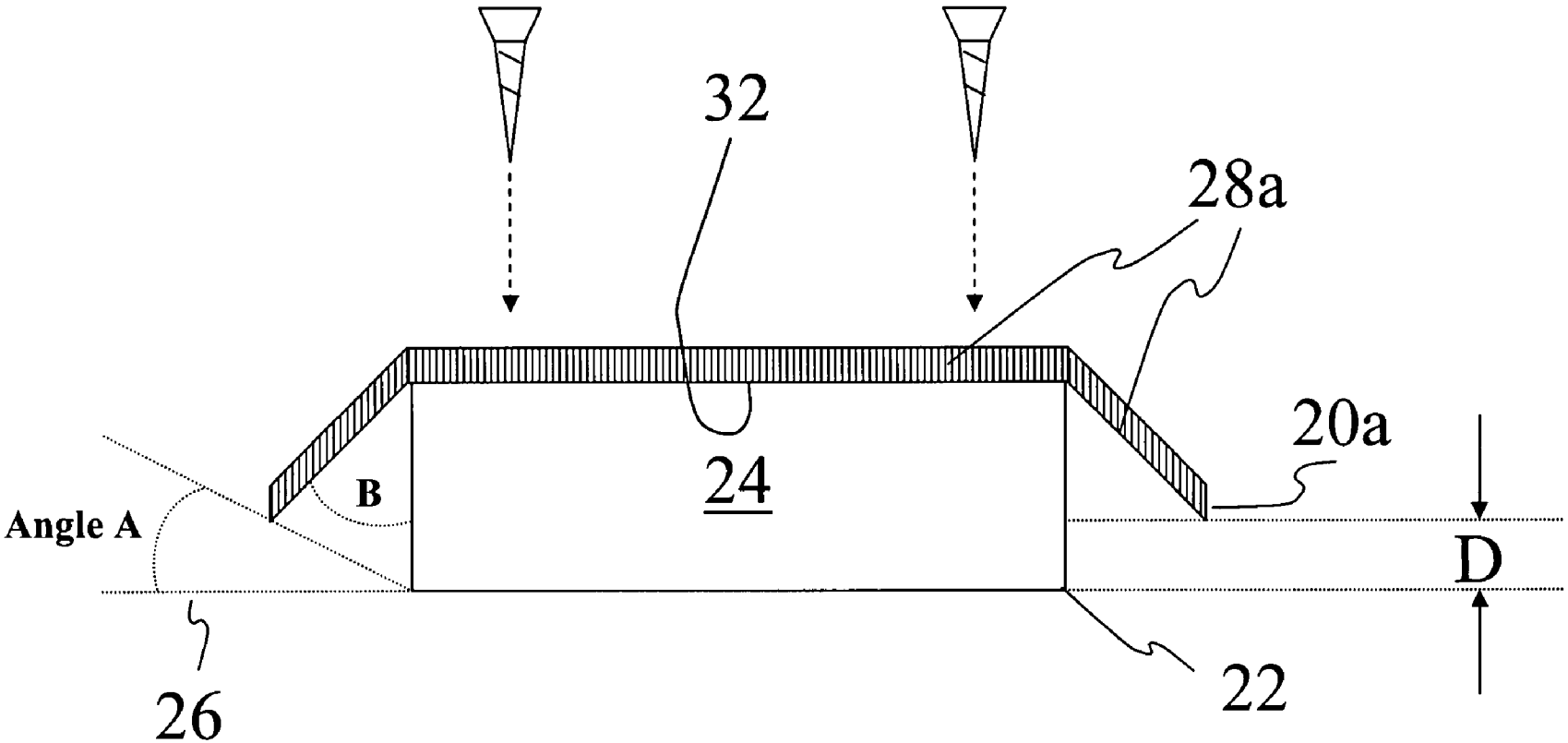
FIG. 1*b* is a cross sectional view of the ski with the outrigger edges of FIG. 1*a;*

Outrigger edge 20*a* enhances ability to stop, turn, and traverse while maintaining control on ice or hard snow, as shown in FIG. 1*a*. Outrigger edge 20*a* is provided outside and spaced from normal edge 22 of ski 24. Outrigger edge 20*a* is also elevated a distance D above normal edge 22 so outrigger edge 20*a* only makes contact with the snow or ice when ski 24 is tilted through approximately angle A with respect to surface 26 of the snow or ice, as shown in FIG. 1*b*. Angle A is preferably in the range from 30 to 60 degrees, more preferably around 45 degrees to reduce or avoid contact during skiing on flat terrain but to allow contact when needed when manoeuvring on ice. Outrigger 20 is fabricated of a material such as 14 gauge stainless steel. It could also be fabricated of a material such as titanium or aluminum. It could also be fabricated of a ceramic composite or a durable plastic.

A skier generally tilts ski 24 with respect to surface 26 while turning or stopping. The skier may also tilt ski 24 with respect to surface 26 while traversing on a steep slope. The skier tilts ski 24 by shifting his or her weight to one side of the ski, and this pressure first causes normal edge 22 to bite into the snow or ice. Once a sufficient angle of tilt has been achieved, outrigger edge 20*a* touches the snow and bites into the surface as well. Outrigger edge 20*a* improves control in icy conditions by facilitating greater penetration or "bite" into surface 26 of the ice or by adding drag in such circumstances.

The actual angle for outrigger 20*a* to contact surface 26 of the snow or ice may be less than angle A, depending on the depth of penetration of normal edge 22 into the snow or ice. With greater such penetration of normal edge 22 a shallower angle than angle A may achieve contact. In testing the invention, the present inventor found that outrigger 20*a* does not interfere with skiing on softer snow where easier penetration of normal edge 22 allows contact with surface 26 with lesser tilt than angle A.

The more the skier tilts ski 24 with respect to the snow surface, the more pressure will be exerted on normal edge 22 and on outrigger edge 20*a*. By contrast, when the skier is tilting ski 24 only slightly with respect to the snow surface, outrigger edge 20*a* will not reach surface 26 of the snow or ice so skiing will not be affected by its presence.

Figure 2A:
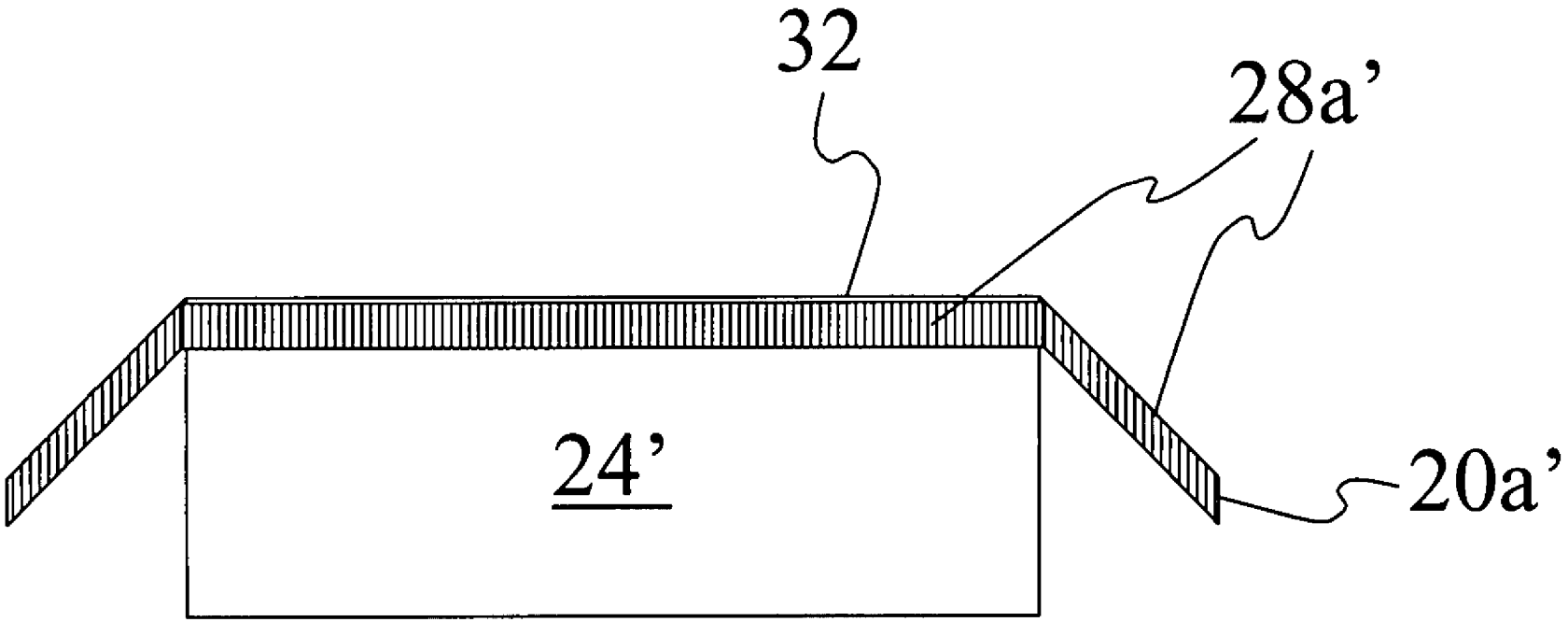
FIG. 2*a* is a cross sectional view of a ski with the outrigger edges of the present invention in which the outrigger edges are integrated with the ski.
Figure 2B:
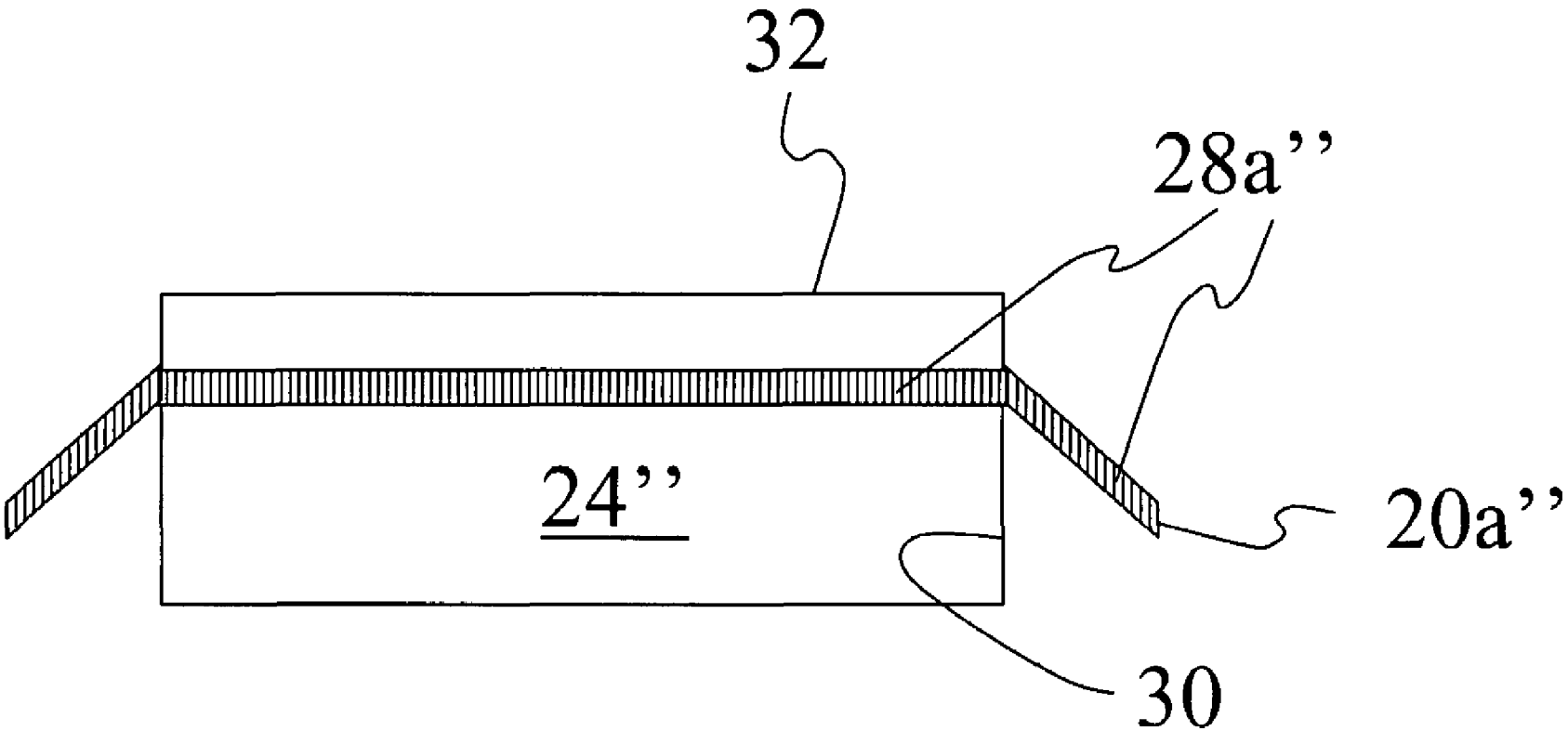
FIG. 2*b* is a cross sectional view of another embodiment of a ski with the outrigger edges of the present invention in which the outrigger edges are integrated with an internal portion of the ski.

Outrigger edge 20*a* may be easily provided to ski 24 by attaching metal sheet 28*a* to ski 24. Metal sheet 28*a* is bent at angle B on each side of ski 24, as shown in FIG. 1*b* to provide outrigger edge 20*a* on each side. Metal sheet 28*a* with outrigger edges 20*a* can thus be added to ski 24 as needed to handle a day having icy conditions. Alternatively, outrigger edge 20*a*' can be integrated with ski 24', as shown in FIG. 2*a*. It can be integral with top surface 32 of ski 24', as shown in FIG. 2*a*, or it can be integral with an inner portion of ski 24", so it extends outwardly from a lower portion of side surface 30 of ski 24", as shown in FIG. 2*b*. Thus, outrigger 20*a* may either be a separate part attached to ski 24, as shown in FIG. 1*a* or it may be integral with ski 24', 24", as shown in FIGS. 2*a*, 2*b*. Metal sheet 28*a*', 28*a*" for outrigger 20*a*', 20*a*", integrated with ski 24', 24", may be permanently adhesively bonded to the adjacent layer or layers of ski 24', 24". Adhesives, such as epoxy can be used for the bonding.

Figure 3:
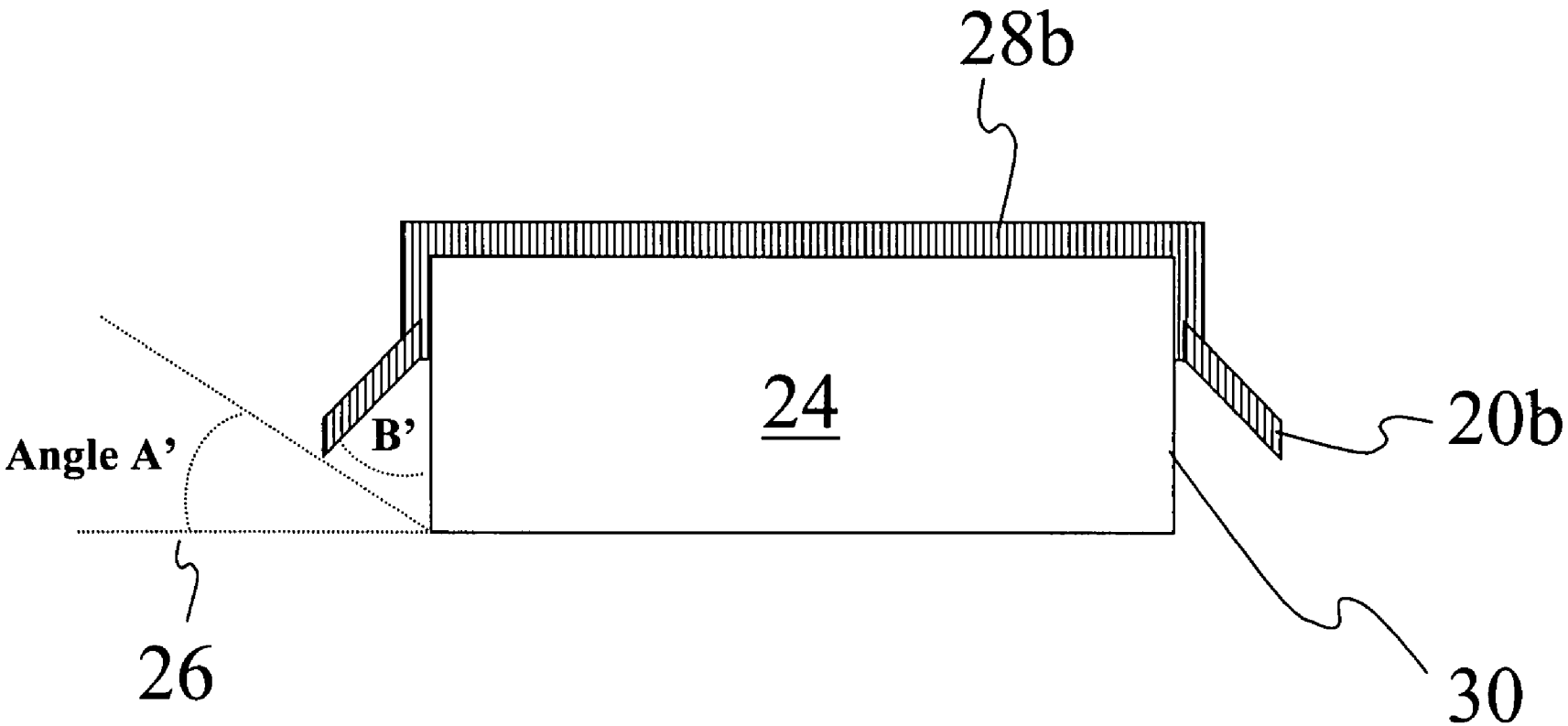
FIG. 3 is a cross sectional view of a ski with a plate having outrigger edges, in which the plate has two bends on each side of the ski to provide the outrigger edges at a lower position along a side surface of the ski.

Two bends can be provided on each side of metal sheet 28*b* to provide outrigger edge 20*b* extending from a lower position along side surface 30 of ski 24, as shown in FIG. 3.

Angle B, B' is preferably in the range from about 30 degrees to about 60 degrees, more preferably it is about 45 degrees. Metal sheet 28*a*, 28*b* is bent to have a width between center bends approximately equal to the width of top surface 32 of ski 24, as shown in FIGS. 1*a*–1*b* to fit snugly on ski 24. Preferably metal sheet 28*a*, 28*b* has holes 36 drilled for mounting to ski 24 with screws 38.

Figure 4A:
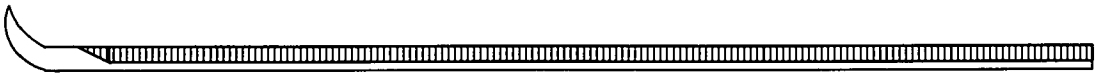
FIG. 4*a* is a side view of a ski with outrigger edges in which the outrigger edges extend substantially along the entire side surface of the ski.
Figure 4B:
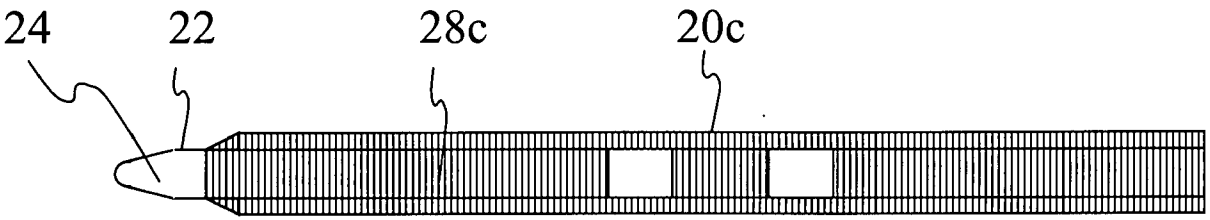
FIG. 4*b* is a top view of the embodiment of FIG. 4*a* showing windows in the metal plate for attaching heel and toe pieces of the binding directly to the ski, allowing the metal plate to be removed without removing the binding.
Figure 5A:
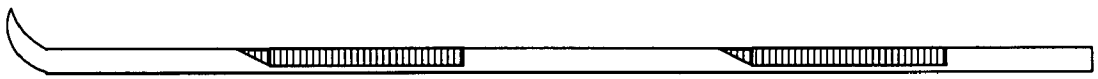
FIG. 5*a* is a side view of a ski with a metal plate having outrigger edges, in which the outrigger edges extend along several portions of the side surface of the ski.
Figure 5B:
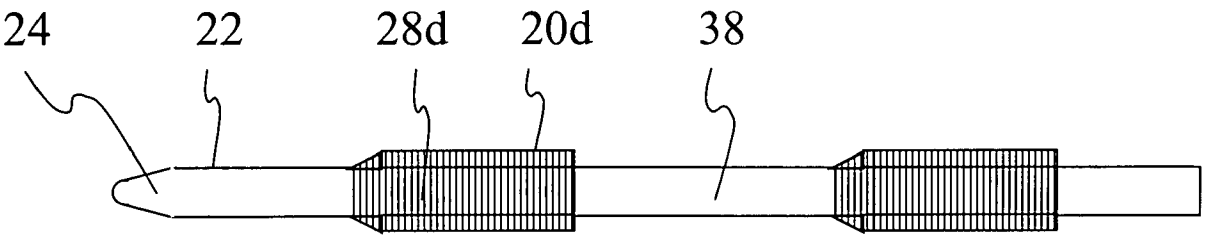
FIG. 5*b* is a top view of the embodiment of FIG. 5*a;*

Metal sheet 28*c* with edge 20*c* may be located spaced from entire edge 22 of ski 24, as shown in FIGS. 4*a*–4*b*. In this case windows are provided in metal sheet 28*c* to allow heel and toe pieces of the binding (not shown) to be directly mounted to ski 24 and to allow metal sheet 28*c* to be removed without interfering with the binding. Alternatively, separate metal sheets 28*d* with edges 20*d* may be provided on either side of location 38 for a ski binding (not shown) that is to be mounted to ski 24 for holding the skier's boot, as shown in FIGS. 5*a*–5*b*.

Figure 6A:
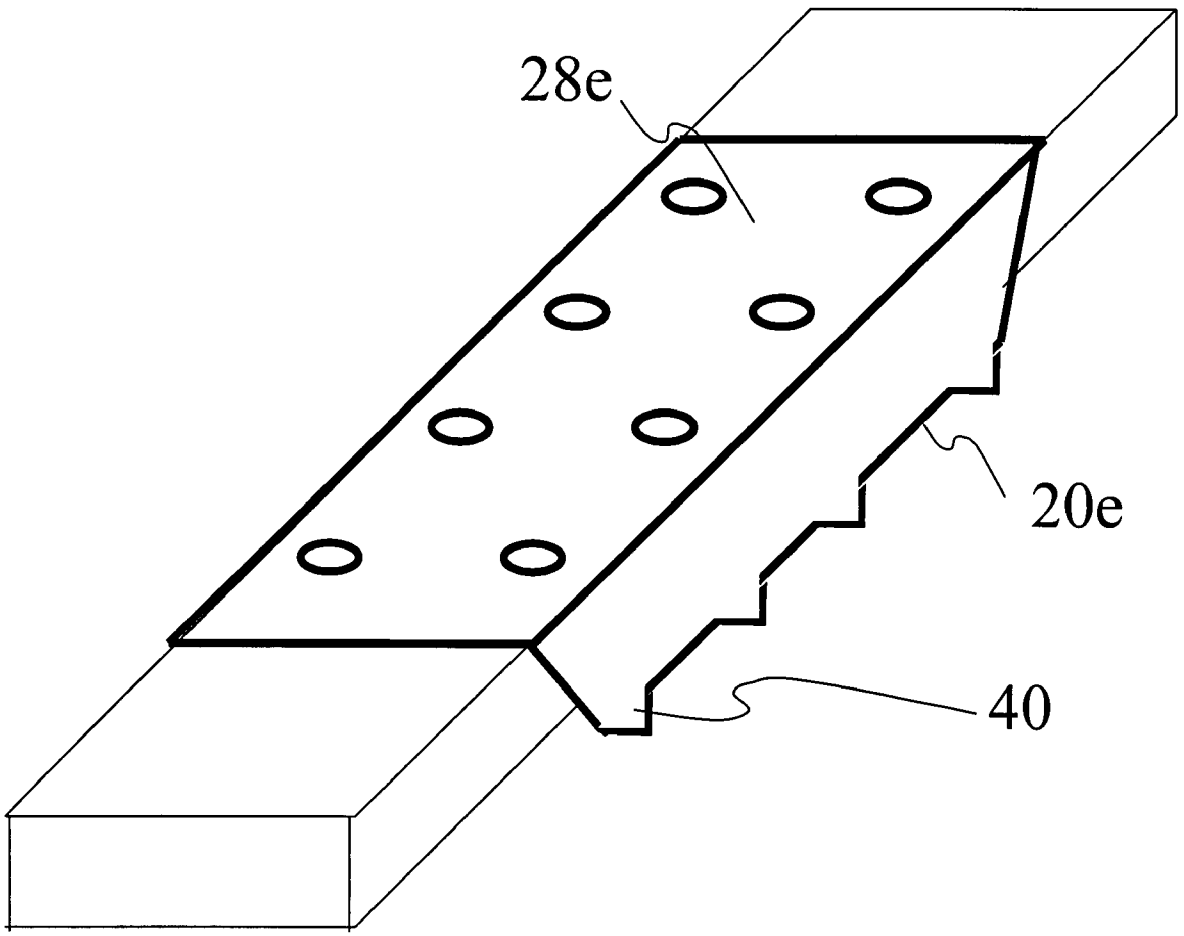
FIG. 6*a* is a three dimensional view of a a ski having a removable metal plate of the present invention in which the plate includes the outrigger edges with widely spaced serrations.
Figure 6B:
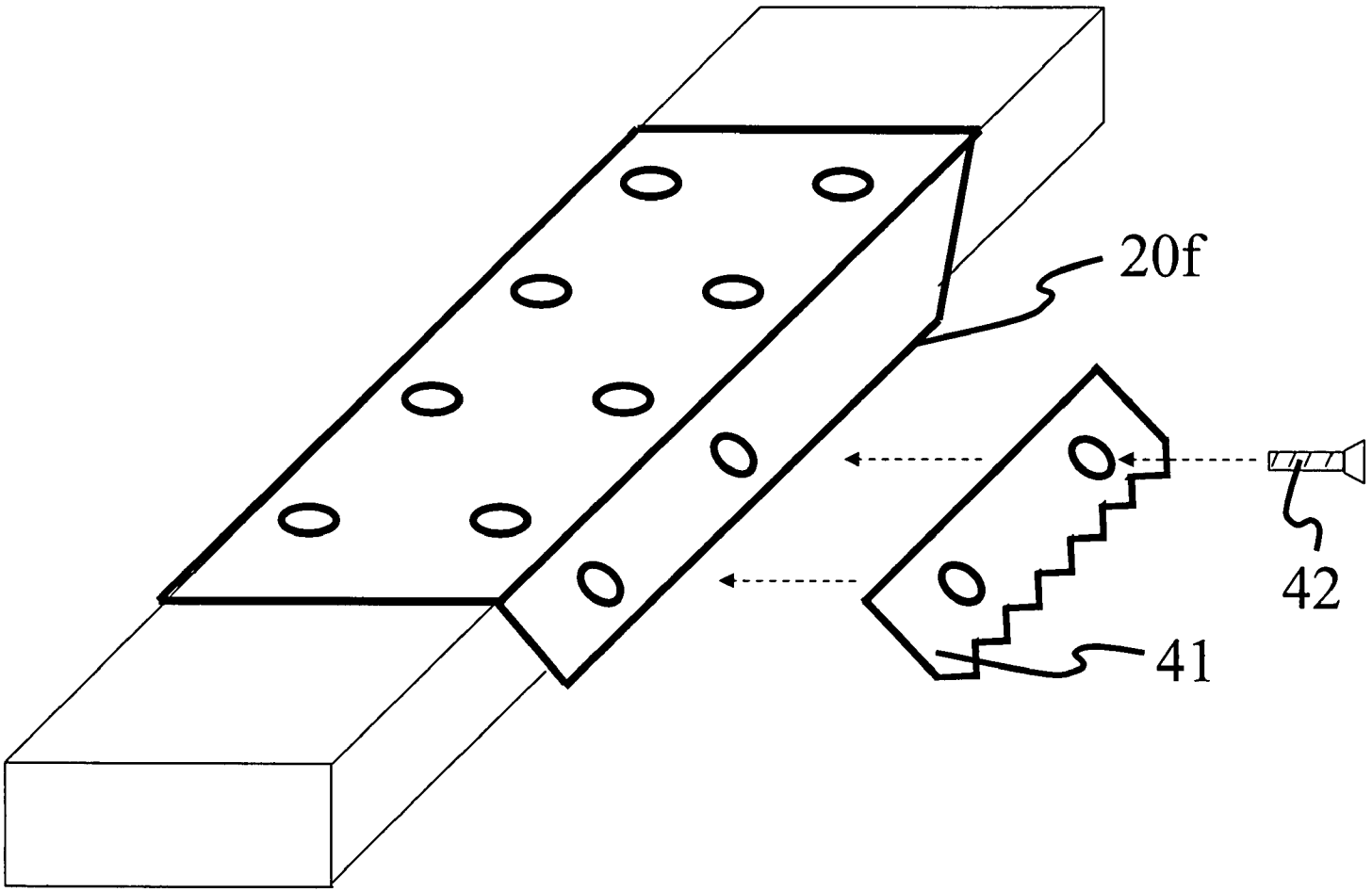
FIG. 6*b* is a three dimensional view of a a ski having a removable metal plate of the present invention in which the plate includes the outrigger edges and there is a second plate having serrations that can be attached to the removable metal plate.

Saw teeth serrations 40 can be provided along at least a a portion of edge 20*e* of metal plate 28*e*, as shown in FIG. 6*a*. Saw teeth serrations 40 can be cut into edge 20*e* of metal plate 28*e*. Alternatively, saw teeth serration plate 41 can be applied to edge 20*f* later with screws 42, as shown in FIG. 6*b*.

Figure 6C:
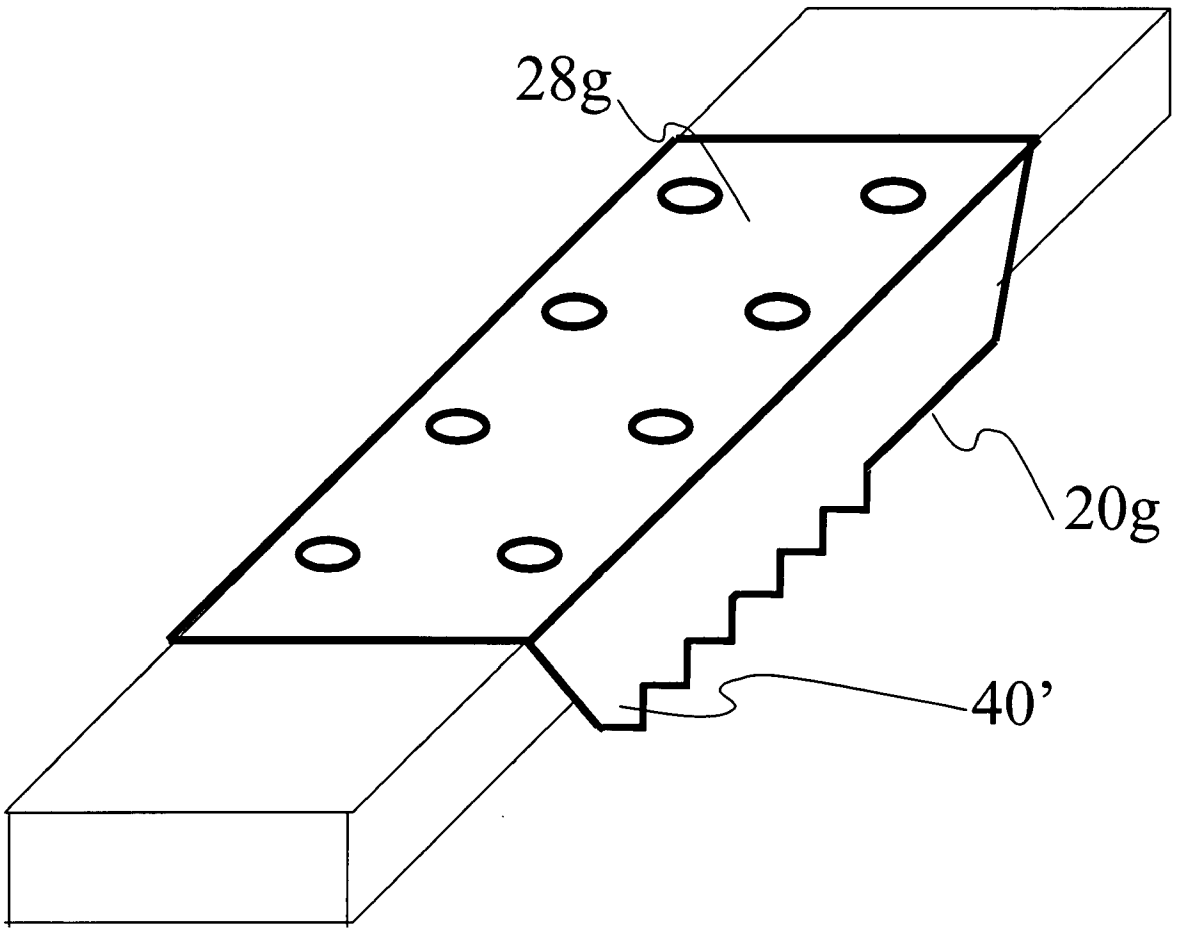
FIG. 6*c* is a three dimensional view of a a ski having a removable metal plate of the present invention similar to the plate of FIG. 6*a* in which the plate includes the outrigger edges with closely spaced serrations.
Figure 6D:
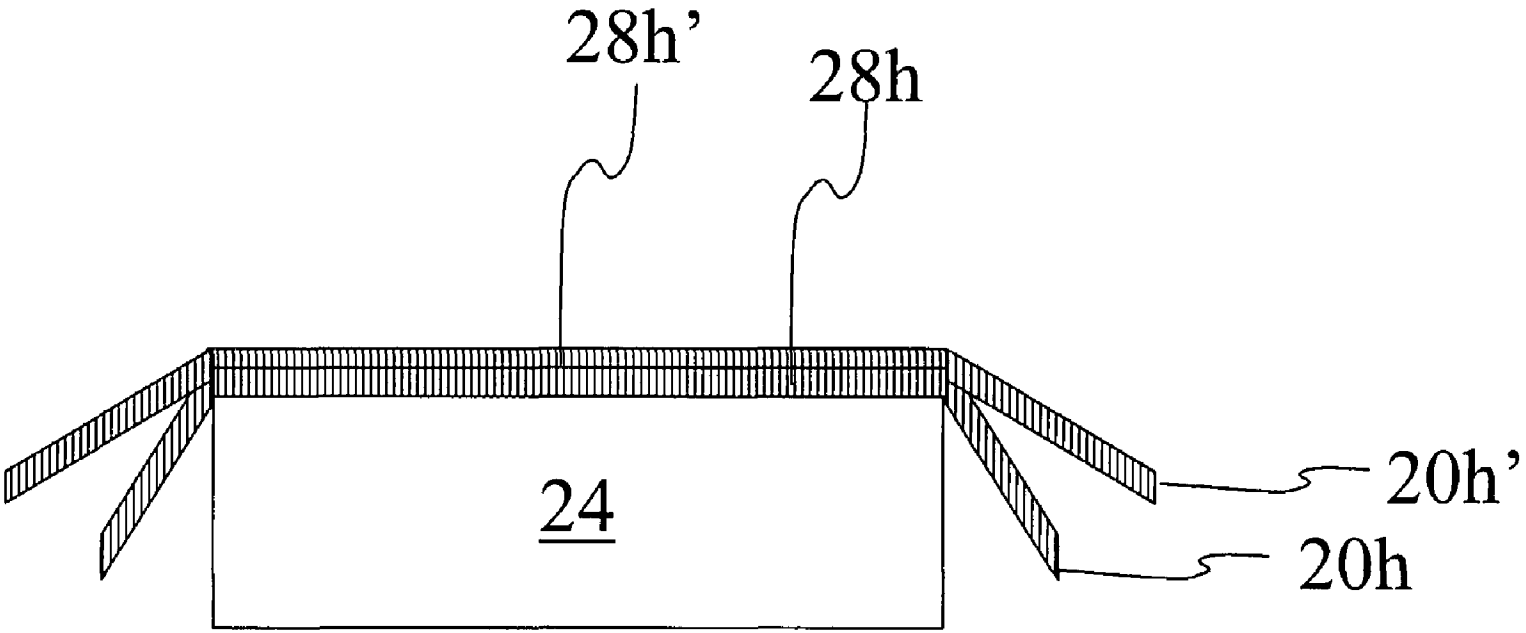
FIG. 6*d* is a cross sectional view of a ski having a pair of removable metal plates of the present invention in which each of the plates includes outrigger edges to provide a pair of outrigger edges on each side of the ski.
Figure 6E:
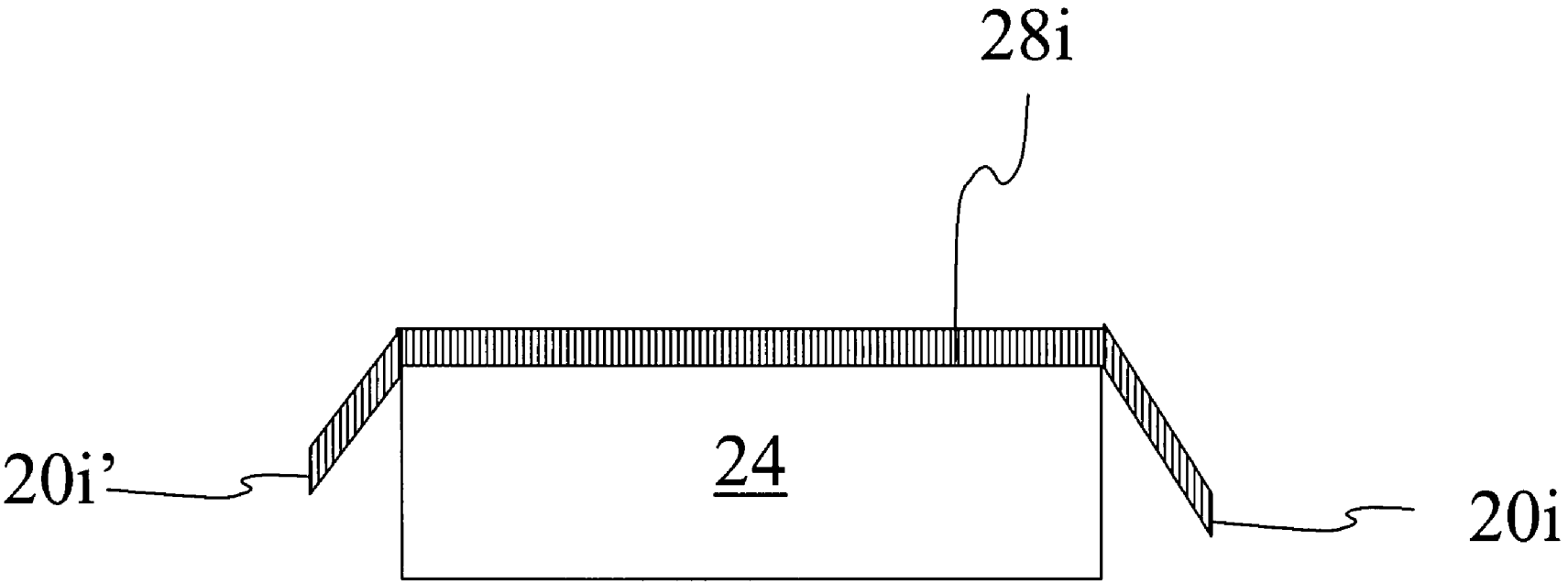
FIG. 6*e* is a cross sectional view of a ski having a removable metal plate of the present invention in which the plate includes the asymmetric outrigger edges.
Figure 6F:
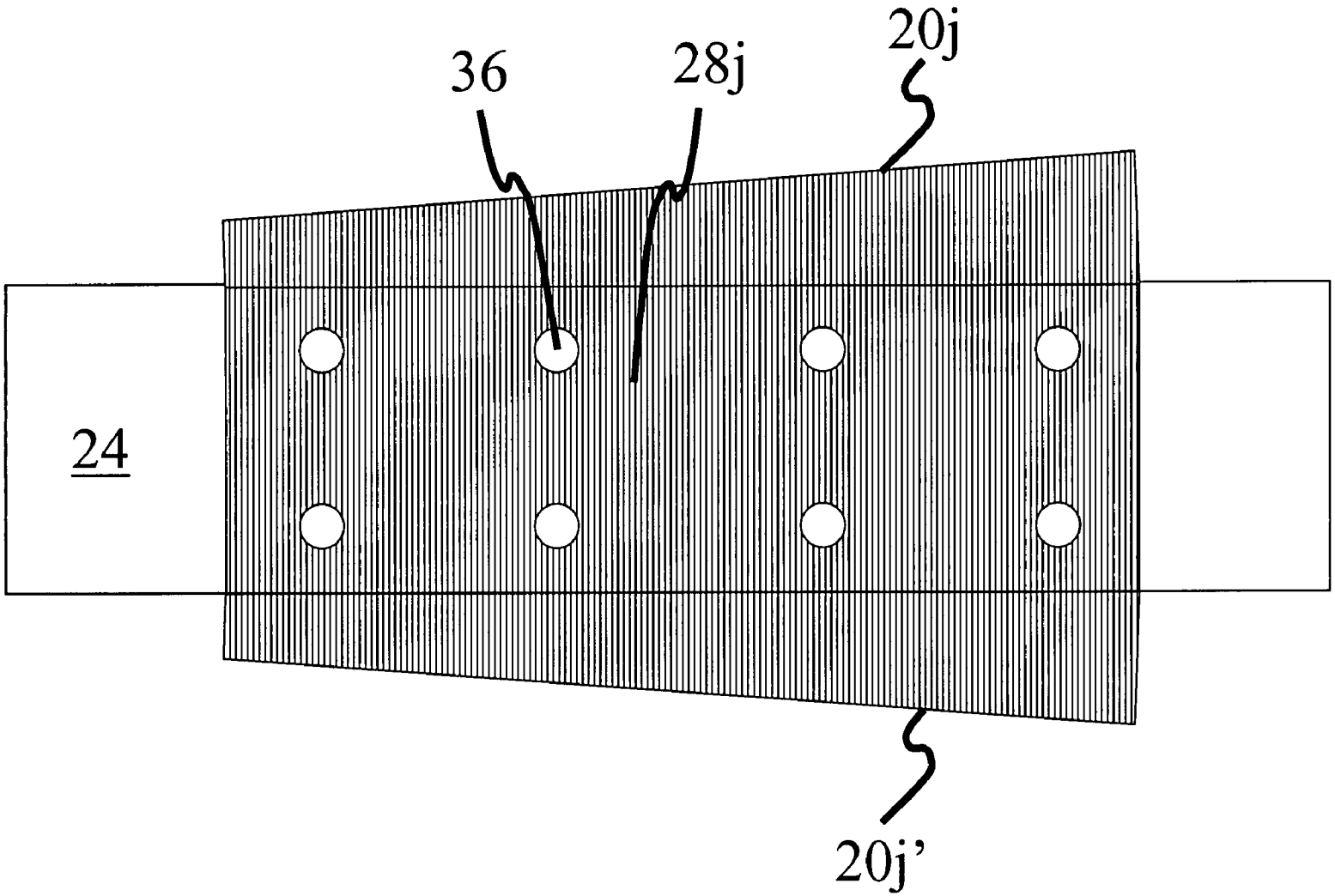
FIG. 6*f* is a top view of a ski having a removable metal plate of the present invention in which the plate includes non-parallel outrigger edges.

Saw teeth serrations 40 on metal plate 28*e* can be widely spaced, as shown in FIG. 6*a* or they may be more closely spaced serrations 40' on at least a portion of edge 20*g* of metal plate 28*g*, as shown in FIG. 6*c*. Alternatively multiple outrigger edges, such as pair of outrigger edges 20*h*, 20*h*', on plates 28*h*, 28*h*' can be provided on each side of ski 24, as shown in FIG. 6*d*. Other kinds of outrigger edge modifications can be provided instead of serrations 40, 40', such as asymmetric edges 20*i*, 20*i*' on plate 28*i*', as shown in FIG. 6*e*, or non-parallel edges 20*j*, 20*j*' on plate 28*j*, as shown in FIG. 6*f*.

While several embodiments of the invention, together with modifications thereof, have been described in detail herein and illustrated in the accompanying drawings, it will be evident that various further modifications are possible without departing from the scope of the invention. Nothing in the above specification is intended to limit the invention more narrowly than the appended claims. The examples given are intended only to be illustrative rather than exclusive.

What is claimed is:

1. A device for skiing, comprising a ski having a first side, a bottom surface, and a bent plate, said bottom surface having a first edge on said first side, said bent plate comprising a first outrigger edge on said first side, wherein said first outrigger edge extends from said ski spaced from said first side, wherein when said bottom surface is facing down, said first outrigger edge is higher than said bottom surface, wherein said outrigger edge has a portion that is serrated.

2. A device, as recited in claim 1, wherein said first outrigger edge extends from said ski parallel to said first edge.

3. A device, as recited in claim 1, wherein said pilate has two bends on each side.

4. A device, as recited in claim 1, wherein said first outrigger edge is integrated with said ski.

5. A device, as recited in claim 1, wherein said ski has a top surface, wherein said first outrigger edge is integrated with said top surface.

6. A device, as recited in claim 5, wherein said ski has a top surface, wherein said outrigger edge is integrated with an inner portion of said ski.

7. A device, as recited in claim 1, wherein said outrigger edge extends substantially along said entire first edge.

8. A device, as recited in claim 1, wherein said outrigger edge extends along only a portion of said first edge.

9. A device, as recited in claim 1, wherein said outrigger edge extends along several portions of said first edge.

10. A device, as recited in claim 1, wherein a plurality of outrigger edges extend along a single portion of said first edge.

11. A device, as recited in claim 1, wherein said portion that is serrated is removable from said outrigger edge.

12. A device, as recited in claim 1, wherein said outrigger edge has a portion that is removable from other portions of said outrigger edge.

13. A device, as recited in claim 1, wherein said plate is removably attached to said ski.

14. A device, as recited in claim 13, wherein said ski has a top surface, wherein said plate is connected to said top surface.

15. A device, as recited in claim 14, wherein said plate is removably attached to said top surface witb a fastener.

16. A device, as recited in claim 1, wherein said ski further includes a second side opposite said first side, wherein said bottom surface further includes a second edge on said second side, and wherein said ski further includes a second outrigger edge on second side, wherein said second outrigger edge extends from said ski spaced from said second side.

17. A device, as recited in claim 16, wherein said first outrigger edge extends from said ski parallel to said first edge and said second outrigger edge extends from said ski parallel to said second edge.

18. A device, as recited in claim 16, wherein when said bottom surface is facing down, said first outrigger edge and said second outrigger edge are both higher than said bottom surface.

19. A device, as recited in claim 16, further comprising a bent plate, wherein said bent plate includes said first outrigger edge and said second outrigger edge.

20. A device, as recited in claim 16, wherein said first outrigger edge is symmetric with said second outrigger edge.

21. A device, as recited in claim 16, wherein said first outrigger edge is parallel with said second outrigger edge.

22. A device, as recited in claim 16, wherein said first outrigger edge is asymmetric or non-parallel with said second outriggeredge.

23. A method of skiing on snow or ice, comprising the steps of a) providing a ski having a bottom surface, a binding, and a bent plate, wherein said bent plate includes an outrigger edge, wherein when said bottom surface is facing down said outrigger edge is higher than said bottom surface, wherein said bent plate is connected to said ski in a location adjacent said binding.

b) skiing on said ski; and c) tilting said ski to engage said outrigger edge with the snow or ice.

24. A method of fabricating a ski for skiing on hard snow or ice, comprising the steps of a) providing a ski having a bottom surface;

b) providing a bent plate having an outrigger edge wherein said outrigger edge has a portion that is serrated; and c) mounting said plate to said ski wherein when said bottom surface is facing down said outrigger edge is higher than said bottom surface.

25. A device for skiing, comprising a ski having a first side, a bottom surface, a binding, and a bent plate, said bottom surface having a first edge on said first side, said bent plate comprising a first outrigger edge on said first side, wherein said first outrigger edge extends from said ski spaced from said first side, wherein when said bottom surface is facing down, said first outrigger edge is higher than said bottom surface, wherein said bent plate is connected to said ski in a location adjacent said binding.

26. A device, as recited in claim 25, wherein said binding has heel and toe pieces, wherein said bent plate is connected in a location between said heel and toe pieces.

27. A device, as recited in claim 26, further comprising additional bent plates connected on both sides of said binding.

28. A device, as recited in claim 25, wherein said binding has heel and toe pieces, wherein said bent plate is connected in a location on both sides of said binding.

29. A device, as recited in claim 26, wherein said binding has heel and toe pieces, wherein said bent plate is connected in a location on both sides of said binding.

* * * * *